United States Patent [19]

Buckner

[11] 4,154,216

[45] May 15, 1979

[54] FIREPLACE GRATE BRACKET

[75] Inventor: Carrol E. Buckner, Weaverville, N.C.

[73] Assignee: Buck Stove Marketing, Corporation, Asheville, N.C.

[21] Appl. No.: 828,785

[22] Filed: Aug. 29, 1977

[51] Int. Cl.[2] ..... F24B 1/26

[52] U.S. Cl. ..... 126/137; 126/30; 126/337 A; 248/296

[58] Field of Search ..... 248/286, 295 C, 296, 248/354 S; 126/137, 30, 336, 337 A, 25 A, 9 R; 99/421, 393

[56] References Cited

U.S. PATENT DOCUMENTS

| | | | |
|---|---|---|---|
| 1,366,872 | 1/1921 | Cantleberry | 248/296 |
| 1,666,293 | 4/1928 | Lorton | 126/30 |
| 2,174,435 | 9/1939 | Boyter | 126/137 |
| 3,455,291 | 7/1969 | Glass | 126/137 |
| 3,785,360 | 1/1974 | Martin | 126/30 |

*Primary Examiner*—John J. Camby
*Assistant Examiner*—Larry I. Schwartz
*Attorney, Agent, or Firm*—Leitner, Palan, Martin & Bernstein

[57] ABSTRACT

A fireplace support bracket having an upright, an adjustable slide having a greater inner effective diameter than the outer effective diameter of the upright, a locking surface extending down from the slide parallel to the upright, and a pin or aperture on the slide to receive a grate whose weight locks the locking surface against the upright in any selected position. The upright includes a pair of pins for mounting the bracket to the hinges of a fireplace.

10 Claims, 5 Drawing Figures

FIG.1
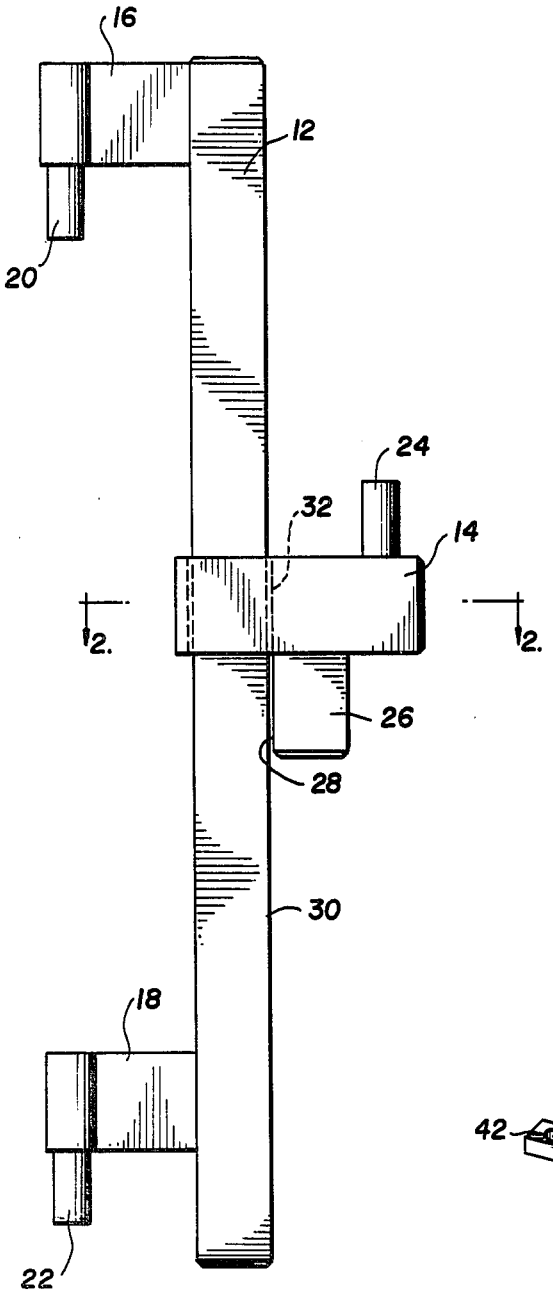
FIG.2
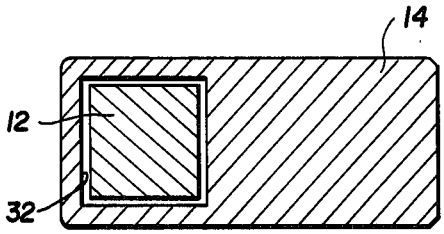
FIG.3
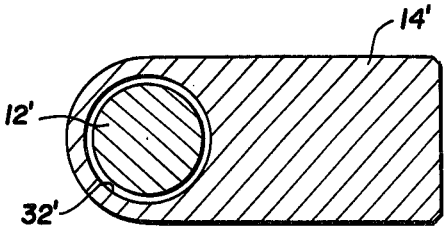
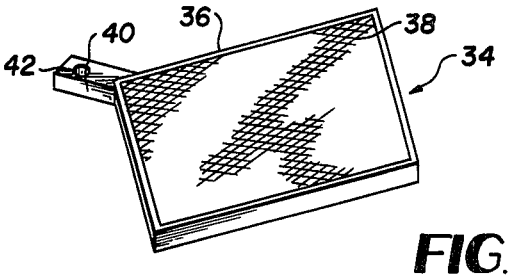
FIG.4
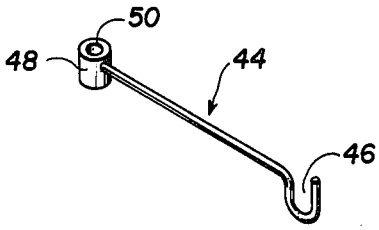
FIG.5

FIREPLACE GRATE BRACKET

BACKGROUND OF THE INVENTION

The present invention relates generally to accessories for fireplaces, and more specifically to a bracket for fireplace supports. Fireplace brackets of the prior art for supports like grates, have generally included an upright with a slide thereon and the slide is locked into position by a screw or other threaded mechanism. These mechanisms generally become heavy with grease, rust, and consequently become very difficult to adjust. Similarly, the adjustment requires two hands, one to support the items on the support and the second hand to manipulate the locking mechanisms and relock it in the desired position. This may be very difficult to do if one is in the middle of cooking and thus requires additional utensils such as mittens.

Another prior art bracket includes an upright having notches thereon along a surface thereof to receive an extended dog portion of the slide to be received in the notches on the surface of the upright. This is limiting in that only the fixed number of positions and heights along the uprights are available at the positions and heights of the openings. As with the previously described bracket, the adjustment of the notched face upright bracket requires substantial tilting of the slide for adjustment and consequently may involve tipping of the item being cooked on the grate or support.

Thus there exists a need for a fireplace bracket which is readily adjustable to an infinite number of positions requiring possibly one hand to adjust with a minimum or no tilting of the support for the items being cooked.

SUMMARY OF THE INVENTION

The fireplace support bracket of the present invention includes an upright having a smooth, regular geometric surface of a first effective diameter and a slide having a second effective inner diameter greater than the first effective diameter and encompassing a portion of the upright. The slide includes a pin or aperture for receiving a support, be it a grate or hangar, and a locking portion extending down from the slide parallel to the surface of the upright. The length of the slide and the relationship of the effective first and second diameter are such that the slide moves freely along the upright when the weight of a support is not placed on the slide and the slide is locked in any desired position by the placement of a weight on the pin to wedge the lower end of the extended locking surface to the surface of the upright. The slide is readily adjustable by relieving the weight of the support which allows the slide to move and then allowing the weight again to force the extended locking surface into the surface of the upright. The cross-section of the outer diameter of the upright and inner surface of the slide either may be rectangular or circular. A pair of pins are provided on the upright to allow the bracket to be mounted to the hinges of the fireplace normally used for the doors.

OBJECTS OF THE INVENTION

An object of the present invention is to provide an improved fireplace support bracket.

Another object is to provide a fireplace support bracket which is readily adjustable.

A further object of the invention is the provision of a fireplace support bracket having an infinite number of adjustable positions.

A still further object of the invention is to provide a fireplace support bracket which minimizes the amount of manipulation required to adjust the height thereof.

Other objects, advantages, and novel features of the present invention will become apparent from the following detailed description of the invention when considered in conjunction with the accompanying drawings.

BRIEF DESCRIPTION OF THE DRAWINGS

FIG. 1 is a side elevation of a fireplace support bracket according to the concept of the present invention.

FIG. 2 is a cross-section taken along lines II—II of FIG. 1.

FIG. 3 is a cross-section of a second embodiment of a fireplace support bracket according to the principles of the present invention.

FIG. 4 is a perspective view of a grill usable with the bracket of FIG. 1.

FIG. 5 is a perspective of a hook for use with the bracket of FIG. 1.

DESCRIPTION OF THE PREFERRED EMBODIMENTS

FIG. 1 illustrates a preferred embodiment of the fireplace support bracket 10 having an upright 12 and a slide 14 thereon. A pair of arms 16 and 18 extend from the top and bottom of an upright 12 and include a pair of pins 20 and 22 extending therefrom. The pins 20 and 22 are received in the opening of hinges provided on the face of the fireplace which normally receives the doors of the fireplace. If the hinge includes a post, apertures would be provided in arms 16 and 18. This allows the capability of the bracket to be mounted to a fireplace while allowing pivotal adjustment of the bracket. The slide 14 includes a pin 24 adjacent the outermost edge thereof for receiving the support. In lieu of pin 24, an aperture may be provided in slide 14. On the same side of the upright 12 is a locking portion 26 extending down from 14 having a surface 28 parallel to the smooth, continuous surface 30 of upright 12. The upright 12 has a smooth, regular geometric surface 30 of a first equivalent diameter and slide 14 has an inner, regular, geometric surface 32 of the same geometric cross-section as surface 30 and of a second effective diameter. The effective diameter of surface 32 is greater than the effective diameter of surface 30. The effective diameter is defined as the diameter of a circle which would encompass the regular geometric cross-section of a surface. For example, the equivalent diameter of the rectangular cross-section as illustrated in FIG. 2 for FIG. 1 would be the diagonal of the rectangle.

The length of locking portion 26 and the difference of the effective diameter of surfaces 30 and 32 are such that the slide 14 moves freely along the upright 12 without interference without a load thereon and the lower end of surface 28 engages the surface 30 to lock the slide in any selected position along upright 12 when a load, for example is mounted to slide 14 by pin 24.

FIG. 3 illustrates a second cross-sectional embodiment wherein the upright 12' has a circular cross-section and the inner surface 32' of upright 14' has an equivalent circular cross-section.

The supports, which may be mounted to receiving pin 24 of the slide, are illustrated in FIGS. 4 and 5 as a grate and a hook respectively. The grate 34 includes a frame 36 and a grading 38. A mounting arm 40 includes an opening 42 to receive pin 24. The hook 44 includes a hooked end 46 for receiving a kettle or any other device and has a mounting portion 48 with an aperture 50 therein to receive pin 24. Although grate 34 and hook 44 have been illustrated, other types of supports may be provided and mounted to the receiving pin 24 of the slide. If an aperture is provided in slide 14, grate 34 and hook 44 would include pins instead of openings 42 and aperture 50.

The slide 14 is a unitary member including the slide body, the receiving pin 24 and the extended locking element 26.

In the preceding description of the preferred embodiments, it is obvious that the objects of the invention are attained. Although the invention has been described and illustrated in detail, it is to be clearly understood that the same is by way of illustration and example only and is not to be taken by way of limitation. The cross-sections illustrated in FIGS. 2 and 3 are only two possible geometric cross-sections which may be used. The essence being that the geometric cross-sections of uprights 12 and slide 14 be geometrically similar and of different effective diameters. The spirit and scope of this invention is to be limited only by the terms of the appended claims.

What is claimed:

1. An adjustable fireplace bracket for a fireplace support comprising: an upright member of a continuous rectangular crossection of a first effective outer diameter; a pair of means spaced along and unitary with said upright member extending from one surface therof for mounting said upright to the door hinge of a fireplace; slide means having a rectangular crossection of a second effective inner diameter for slidably encompassing said upright member; extended member unitary with said slide means and extending down therefrom along the axis of and adjacent to a single surface of said upright member opposite said pair of mounting means; receiving means unitary with said slide means for mounting a support to said slide means; said second diameter being sufficiently greater than said first diameter to allow said slide means to move freely on said upright member without said support while cooperating with said extended member to lock said slide means on said upright member with said support mounted to said receiving means.

2. The fireplace bracket according to claim 1 wherein said receiving member is an aperture having an axis parallel to the axis of said upright member.

3. The fireplace bracket according to claim 1 wherein said pair of mounting means each includes a horizontal arm with an aperture therein.

4. The fireplace bracket according to claim 1 wherein said mounting means and said receiving means are pins extending parallel to the longitudinal axis of said upright member.

5. A bracket for a fireplace support comprising: an upright having a continuous surface of a first effective diameter;

a pair of means spaced along and unitary with said upright for mounting said upright to a pair of door hinges of a fireplace;

slide means encompassing a portion of said upright and having a second effective inner diameter greater than said first diameter;

receiving means unitary with said slide means and adjacent to a first edge of said slide means for mounting a support to said slide means; and lock means unitary with said slide means and extending down from said slide means parallel to said upright for engaging said continuous surface of said upright when a support is mounted to said receiving means to lock said slide means on said upright and for allowing free movement of said slide without the weight of said support.

6. The bracket according to claim 5 wherein the outer surface of said upright and the inner surface of said slide means are of circular cross cross section.

7. The bracket according to claim 5 wherein said pair of mounting means each includes a horizontal arm with an aperture therein.

8. The bracket according to claim 5 wherein the surface of said lock means opposite the upright is an extension of a portion of the inner diameter of said slide means.

9. The bracket according to claim 5 wherein the outer surface of said upright and the inner surface of said slide means are of rectangular cross cross section.

10. The bracket according to claim 5 wherein said receiving means is an aperture having an axis parallel to the axis of said upright.

* * * * *